United States Patent [19]

Niimura et al.

[11] Patent Number: 5,044,124

[45] Date of Patent: Sep. 3, 1991

[54] FINISHING MACHINE FOR CAST PRODUCTS

[75] Inventors: Tatsuo Niimura; Takenori Kitazawa, both of Nagano, Japan

[73] Assignee: Kabushiki Kaisha Koyama, Nagano, Japan

[21] Appl. No.: 510,306

[22] Filed: Apr. 16, 1990

[30] Foreign Application Priority Data

Apr. 20, 1989 [JP] Japan ..... 1-101195

[51] Int. Cl.[5] ..... B24B 49/00

[52] U.S. Cl. ..... 51/165.77; 51/165.87; 51/99

[58] Field of Search ..... 51/165.71, 165.77, 165.87, 51/47, 68, 99, 126

[56] References Cited

U.S. PATENT DOCUMENTS

| | | | |
|---|---|---|---|
| 2,811,874 | 11/1957 | Rethoret | 51/99 |
| 2,818,058 | 12/1957 | Zuzelo | 51/99 |
| 2,863,440 | 12/1958 | Harclerode | 51/99 |
| 3,040,729 | 6/1962 | Ward | 51/99 |

*Primary Examiner*—M. Rachuba

*Attorney, Agent, or Firm*—Jordan and Hamburg

[57] ABSTRACT

The present invention provides a finishing machine for casted products, which can uniformly remove fins on circumferential side faces, upper face, etc. of casted products by correcting amount of abrasion of a rotary grindstone. Therefore, the finishing machine for casted products has means for detecting the amount of abrasion of the rotary grindstone and means for correcting which adds the amount of abrasion of the rotary grindstone to the amount of travel of the rotary grindstone and a work.

6 Claims, 15 Drawing Sheets

FINISHING MACHINE FOR CAST PRODUCTS

FIELD OF THE INVENTION AND RELATED ART STATEMENT

The present invention relates to a finishing machine for cast products, which removes fins and unnecessary parts cast on the products to finish.

As shown in FIG. 20, casting is executed by pouring molten metal into a gate of mold from a ladle. The mold is composed of a combination of an upper mold and a lower mold. Therefore, molten metal gets into the gap between the lower mold 1*a* and the uppoer mold 1*b*, so that casting fins are formed in the gap. Further, the mold also has a gate 9*a* for pouring molten metal therein, gas vents 9*b* for letting out gas in the molten metal and a feeder head 9*c* for pouring additional molten metal into product section in which molten metal contracts when it is cooled. With this structure of the mold, the cast product has unnecessary parts, fins are formed to correspond to the gate, the gas vents and the feeder head. Further, core-fins are sometimes formed on the product when a core is set in the mold. Therefore, the product has casting fins, core-fins and unnecessary cast parts (they will be described as "fins" in the following description). The fins should be removed in following manufacturing process.

Conventionally, the fins are removed by pressing a casted product on circumferential face of a rotary grinder.

A finishing machine shown in FIG. 21 is known for removing fins on casted products. In the finishing machine, a rotary grindstone 2 driven by a motor 3 is moved close to a cast product 4, which is clamped by a clamping means, so as to remove fins on the product 4. The vertical position of the rotary grindstone with respect to the product 4 is controlled by vertical movement of a table 7, which is moved by rotation of a ball bearing screw driven by a serve motor 5. The rotary grindstone 2 can be also moved to and away from the product 4 on the table 7 by a cylinder unit 8.

However, it is dangerous to manually grind the product by the rotary grinder because there is a risk that a worker touches the grinder and gets injured.

While, it is preferable for removing fins on the circumferential face of the product to use the finishing machine but the machine cannot remove fins on the upper and slope faces thereof. To remove fins on the faces, the position of the product clamped should be changed. And the rotary grindstone 2 wears when removing fins on the product, so that the rotary grindstone wore cannot perfectly remove fins even it is controlled by N.C. control system.

OBJECT AND SUMMARY OF THE INVENTION

The object of the present invention is to provide a finishing machine for cast products in which the movement of the rotary grindstone can be corrected according to the amount of abrasion of the rotary grindstone so as to perfectly remove fins on the upper and circumferential faces of the cast products.

To achieve the object, the present invention has following structure.

Namely, in a finishing machine for cast products comprising a horizontal drive mechanism and a vertical drive mechanism for relatively moving close a work and a rotary grindstone so as to remove fins, etc. on the work by the rotary grindstone, wherein the improvement comprises, means for controlling the movement of the rotary grindstone and the work, means for detecting the amount of abrasion of the rotary grindstone, and means for correcting the movement of the rotary grindstone and the work by adding the amount of abrasion of the rotary grindstone to the amount of movement of the rotary grindstone and the work.

And concretely, in a finishing machine for cast products comprising a rotary grindstone for removing fins, etc. on a work with relatively moving close to the work, wherein the improvement comprises, a clamp-base being movable in the horizontal X-direction, a clamping device for clamping the work, the clamping device is provided on the clamp-base and can be rotated on the A-axis perpendicular to the X-direction, a grindstone-base being movable in the horizontal Z-direction perpendicular to the X-direction so as to move to and away from the clamp-base, a support-shaft whose one end is pivotably attached to a shaft on the grindstone-base, the support-shaft being swingable on the shaft in a vertical plane perpendicular to the X-direction, an elevating block being movable on the support-shaft, a link whose one end can be moved on the support-shaft by the movement of the elevating block, the one end of the link is pivotably attached to the elevating block and the other end thereof is pivotably attached to the grindstone-base, a swing arm being pivotably attached to the elevating block in the midway thereof so as to be swingable in a vertical plane perpendicular to the X-direction, the rear end of the swing arm can be moved along a guide section in the Z-direction, the rotary grindstone, which rotates on a rotary shaft in the X-direction and which can be moved in the Y-direction by the movement of the elevating block, is provided at the front end of the swing arm, means for controlling drive units of the clamp-base, the clamping device, the grindstone-base and the elevating block so as to remove fins, etc. produced on the upper face and/or the circumferential faces of the work, means for detecting the amount of abrasion of the rotary grindstone, and means for correcting the amount of travelling the grindstone-base and/or the elevating block corresponding to the amount of abrasion of the rotary grindstone.

Further concretely, in a finishing machine for cast products comprising a rotary grindstone for removing fins, etc. on a work with relatively moving close to the work, wherein the improvement comprises, a clamp-base being movable in the horizontal X-direction, a clamping device for clamping the work, the clamping device is provided on the clamp-base and can be rotated on the A-axis perpendicular to the X-direction, a grindstone-base being movable in the horizontal Z-direction perpendicular to the X-direction so as to move to and away from the clamp-base, a support-shaft whose one end is pivotably attached to a shaft on the grindstone-base, the support-shaft being swingable on the shaft in a vertical plane parallel to the X-direction, an elevating block being movable on the support-shaft, a link whose one end can be moved on the support-shaft by the movement of the elevating block, the one end of the link is pivotably attached to the elevating block and the other end thereof is pivotably attached to the grindstone-base, a swing arm being pivotably attached to the elevating block in the midway thereof so as to be swingable in a vertical plane perpendicular to the X-direction, the rear end of the swing arm can be moved along a guide section in the X-direction, the rotary grindstone, which rotates on a rotary shaft in the X-direction and which can be moved in the Y-direction by the movement of the elevating block, is provided at the front end of the swing arm, means for controlling drive units of the clamp-base, the clamping device, the grindstone-base and the elevating block so as to remove fins, etc. produced on the upper face and/or the circumferential faces of the work, means for detecting the amount of abrasion of the rotary grindstone, and means for correcting the amount of travelling the grindstone-base and/or the elevating block corresponding to the amount of abrasion of the rotary grindstone.

Further preferably, the means for correcting adds the amount of abrasion of the rotary grindstone to the amount of travelling of the rotary grindstone in the Z-direction when fins, etc. on the face parallel to the A-axis are removed, the means for correcting adds the amount of abrasion to the amount of travelling of the rotary grindstone in the Y-direction when fins, etc. on the upper face parallel to the clamp-base are removed, and the means for correcting divides the amount of abrasion to add to each of the amount of travelling of the rotary grindstone in the Z-direction and Y-direction when fins, etc. on slope and curved faces are removed.

Further, the machine may further comprise, a grindstone cover covering over the rotary grindstone, whose one part is exposed therefrom, the grindstone cover being coaxial to the rotary grindstone and can be rotated, and means for controlling the position of the grindstone cover to face the exposed part of the rotary grindstone to a face on which fins, etc. are produced.

And further, a bearing for rotatably supporting the rotary grindstone and a motor for driving the rotary grindstone may be respectively fixed at both ends of a rotary shaft, which can be rotated on an axis in the Z-direction and which is rotatably supported by bearings fixed at the front end of the swing arm.

Succesively, the function will be described.

In case that the rotary grindstone wears, the means for detecting detects the amount of abrasion, and the means for correcting adds the amount of abrasion to the amount of travelling of the rotary grindstone, so that fins are perfectly removed.

Further, the finishing machine having the rotary mechanism can rotationally changed the direction of the direction of the rotary grindstone.

With above described structures and functions, the finishing machine of the present invention has following advantages:

(a) Once a cast product is set, fins on side faces, upper face, slope faces and curved faces can be removed without changing the position of the casted product.

(b) Uniform finishing work can be executed because the amount of abrasion of the rotary grindstone is detected and the means for correcting adds the amount of abrasion to the amount of travelling of the rotary grindstone so as to correct the movement of the rotary grindstone.

(c) Removing work can be executed safer because the exposed part of the rotary grindstone can be directed to faces of the cast product, on which fins have been produced, by the means for controlling the position of the grindstone cover.

With the rotary mechanism, fins in concave section of the cast product can be removed.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

EMBODIMENTS

Preferred embodiment of the present invention will now be described in detail.

Figure 1:
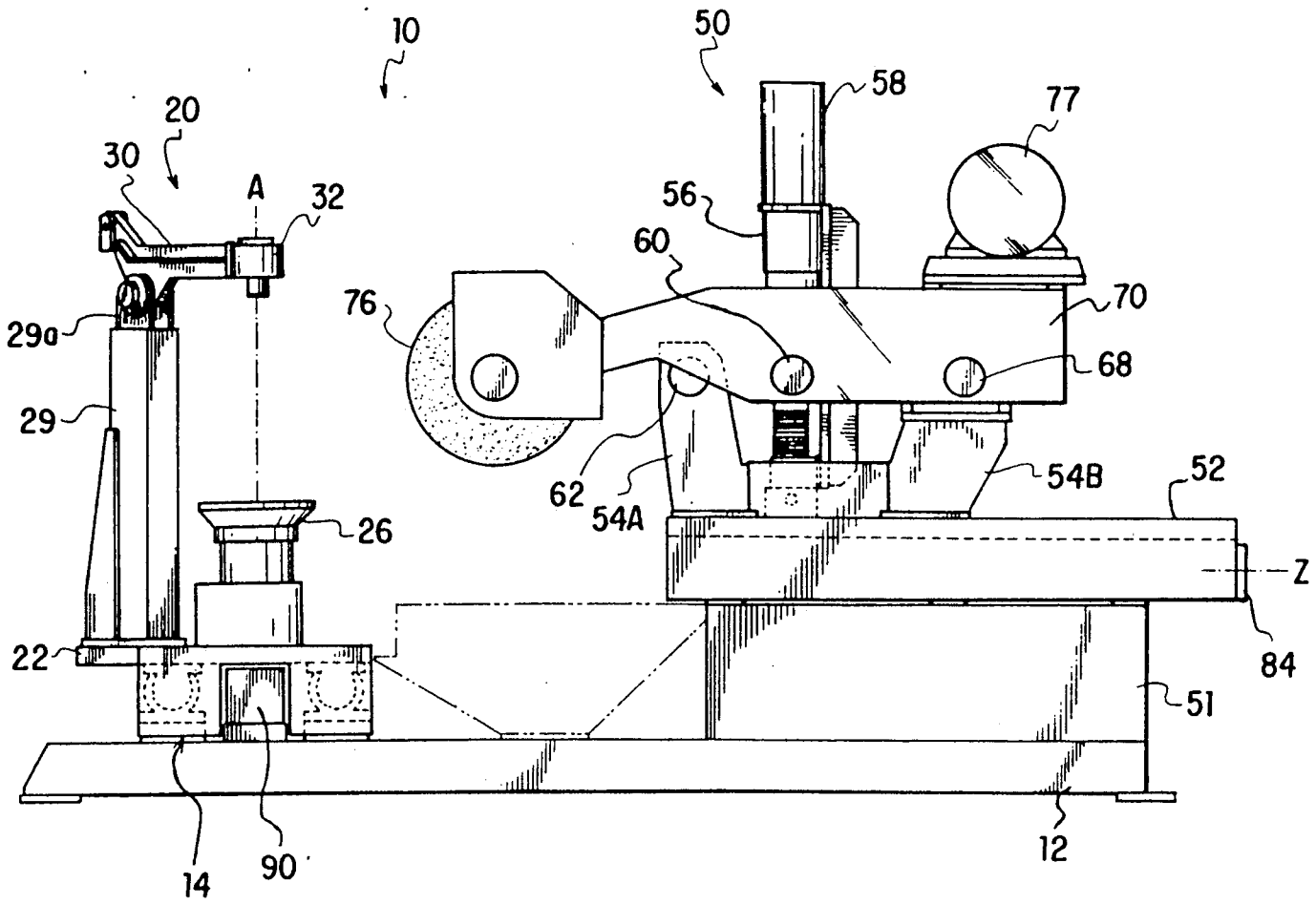
FIG. 1 shows a schematic front view of the finishing machine for cast products of the present invention.
Figure 2:
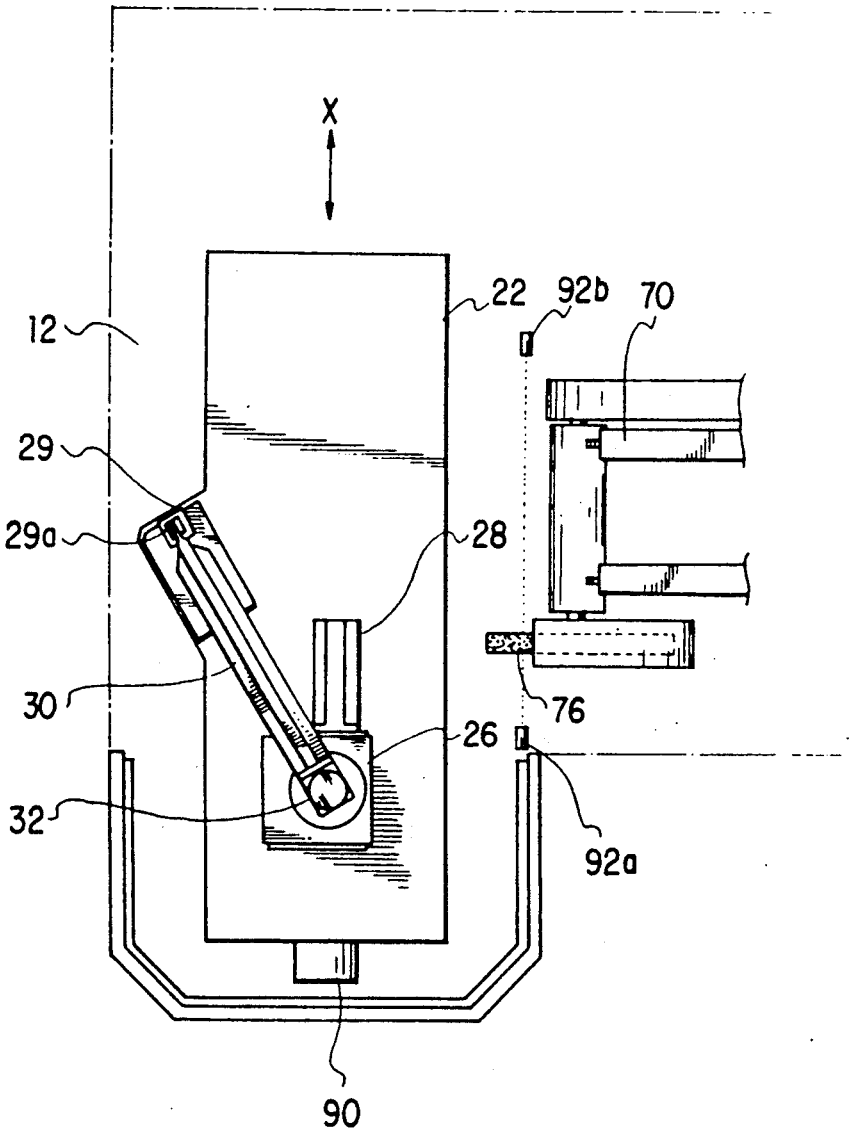
FIG. 2 shows a plan view of a clamping device.
Figure 3:
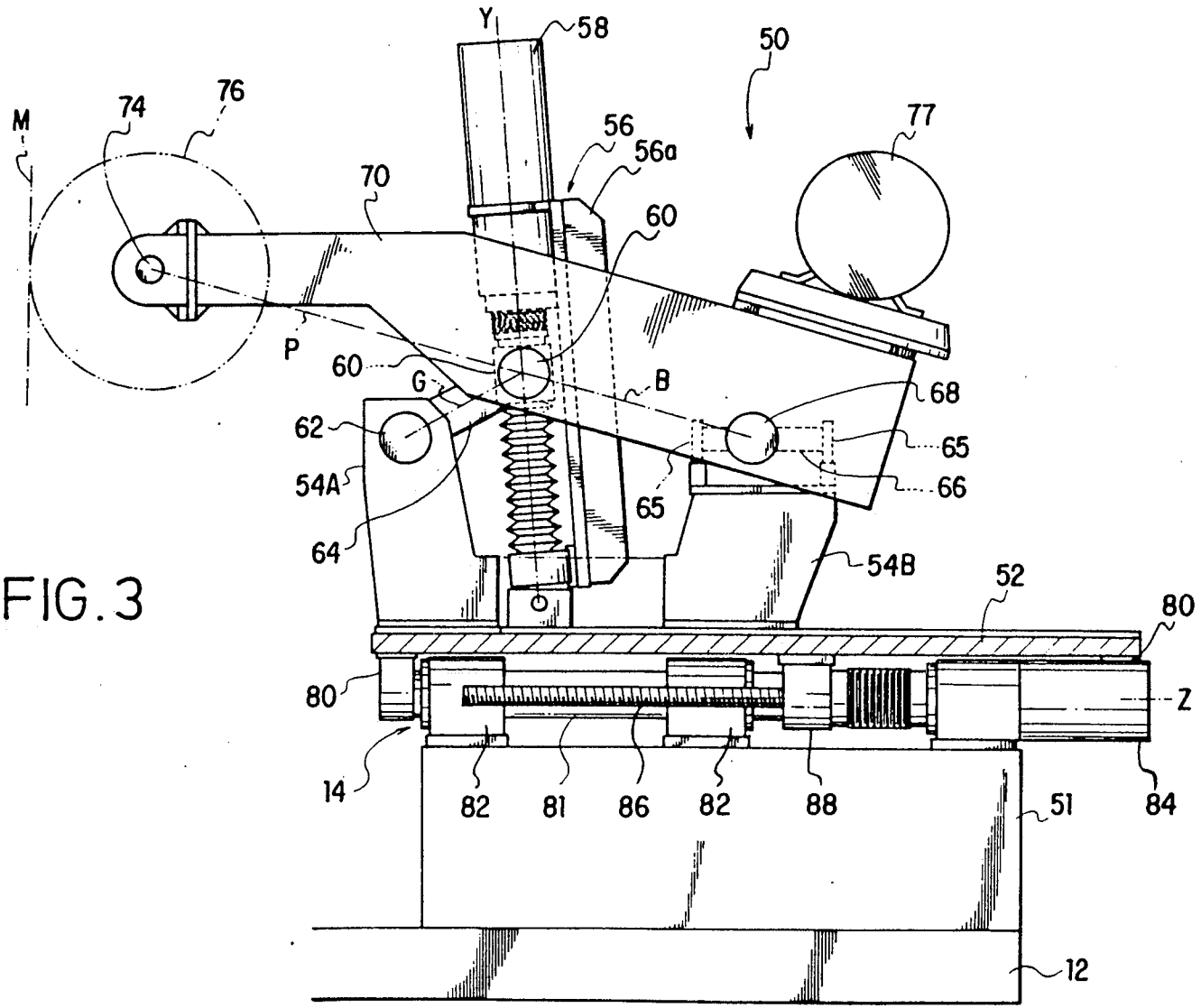
FIG. 3 shows a front view of a grindstone-drive section.
Figure 4:
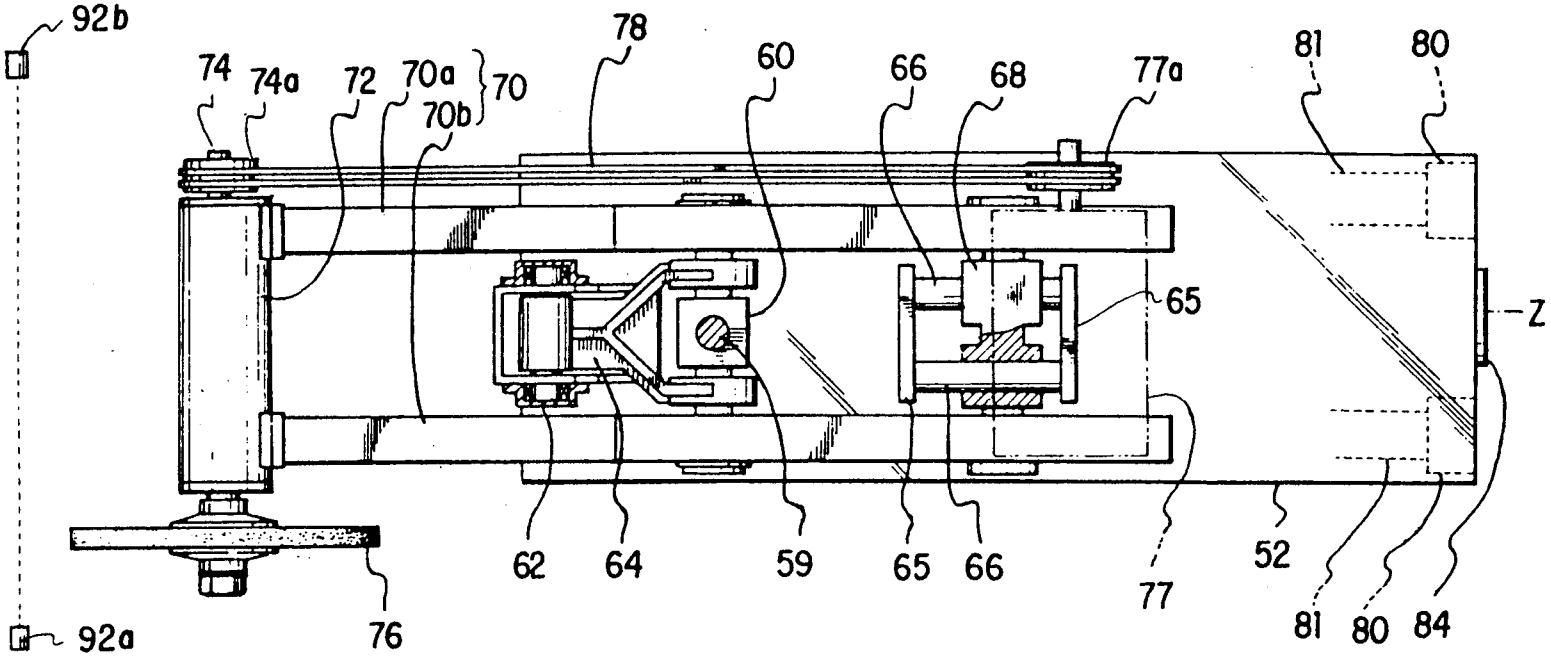
FIG. 4 shows a plan view of a grindstone-drive section.

FIG. 1 shows a schematic front view of the finishing machine of the present invention, FIG. 2 shows a plan view of a clamping device, FIG. 3 shows a front view of a grindstone-drive section of the finishing machine, and FIG. 4 shows a plan view of the grindstone-drive section thereof.

The finishing machine 10 has a clamping device 20 for clamping a cast product and a grindstone-drive section 50, which is provided to face the clamping device 20 and which moves a rotary grindstone close to and away from the product clamped by the clamping devide 20. Note that, the clamping device 20 and the grindstone-drive section 50 are provided on a machine frame 12. And the whole machine is covered with a casing.

First, the clamping device 20 will be explained.

A clamp-base 22 is movably provided on the machine frame 12 and connected to a drive unit 14. The clamp-base 22 can be moved in the vertical direction with respect to the paper face of the drawing of FIG. 1 and this direction is defined as X-direction (X-axis). A clamp-table 26 is rotatably attached on the clamp-base 22. The rotational axis of the clamp-table 26 is defined as A-axis. There is provided an A-axis-motor 28 for rotating the clamp-table 26 on the A-axis on the clamp-table 28 (see FIG. 2).

A clamp-pillar 29 stands in the center of the edge section of the clamp-base 22, the clamp-pillar has a telescopic slidable member 29*a*, and a clamp-arm 30 is rotatably attached to the top end of the slidable member 29*a*. There is provided a clamp head 32, which can be rotated on the A-axis when a cast product is clamped between the clamp head 32 and the clamp-base 26, at the front end of the clamp arm 30.

Namely, the cast product clamped by the clamp-base 26 and the clamp head 32 can be rotated on the A-axis by the A-axis-motor 28.

Successively, the grindstone-drive system 50 will be described with especially reference to FIGS. 3 and 4.

A grindstone-base 52 connected to the drive unit 14 is provided on a base 51 fixed to the machine frame 12.

Two pillars 54A and 54B are stand serially in the front section (on the clamping device 20 side) of the grindstone-base 52. There is swingably provided a support-shaft 56, which can be swung back and forth, between the pillars 54A and 54B. Namely, the lower end of the support-shaft 56 is pibotably attached and the top end thereof can be swingable to move close to and away from the clamping device 20. The support-shaft 56 includes a Y-axis-motor 58 set in the upper section, a ball bearing screw 59 connected to the drive shaft of the Y-axis-motor 58 and whose lower end is rotatably supported, and an elevating block 60 through which the ball bearing screw 59 is screwed and which travels up and down with the rotation of the ball bearing screw 59 along the ball bearing screw 59 are connected by a connecting member 56*a*. The elevating block 60 and the shaft 62 of the upper section of the forward pillar 54A are connected by a second link 64.

On the upper face of the pillar 54B, there are serially standing plates 65 and 65, which are facing one another, and guide-bars 66 and 66 are provided in parallel to connect the plates 65 and 65. A movable shaft 68 is movably provided on the guide-bars 66 and 66.

Midway sections and rear sections of two side plates 70*a* and 70*b* are rotatably attached to the elevating block 60 and the both ends of the movable shaft 68. A first link 70 includes these side plates 70*a* and 70*b* to form a swing arm. A bearing 72 of the rotary grindstone 76 is fixed at the front end of the first link 70. A rotary shaft 74, which is rotatably supported by the bearing 72, is projected from both end faces of the bearing 72, the rotary grindstone 76 is fixed at one end of the rotary shaft 74 and a pulley 74*a* is fixed at the other end thereof.

While, on the upper rear end face of the first link 70, there is fixed a driving motor 77. A belt 78 is engaged with a pulley 77*a* fixed at the front end of the drive shaft of the driving motor 77 and a pulley 75*a* of the rotary shaft 74 of the rotary grindstone 76.

The drive unit of the grindstone-base 52 will now be explained.

The grindstone-base 52, which is movable in the horizontal direction perpendicular to the X-axis, is provided on the base 51. The moving direction of the grindstone-base 52 is defined as Z-axis.

Two sets of supporting members are downwardly extended from the front and rear end sections of the bottom face of the grindstone-base 52 so as to support two guide-bars 81 (only one of which is seen in FIG. 3), which are arranged along both side fringes of the width direction of the grindstone-base 52. The two guide-bars 81 are respectively supported by two guide blocks 82 provided on the base 51.

A Z-axis-motor 84 is provided in the clearance between guide rods 81. The Z-axis-motor 84 is fixed on the base 51 and a screw-guide 86 is provided coaxial to the drive shaft of the motor 84. The screw-guide 86 is screwed through a movable block 88, which is downwardly provided on the bottom face of the grindstone-base 52.

Therefore, the screw-guide 86 rotates to move the movable block 88 when the Z-axis-motor 84 is driven. Whereby the grindstone-base 52 moves along the guide rods 82 and 82 (see FIGS. 3 and 4).

The drive unit 14 for driving the clamp-base 22 has the same structure to the drive unit 14 of the grindstone-base 52. Note that, the driving motor for driving the clamp-base 22 is defined as X-axis-motor 90.

The elevating block 60 at the joint section of the first link and the second link can be moved up and down by the rotation of the ball bearing screw 59, the first link 70 and the second link 64 are connected, and the rear end of the first link is slidable, so that the elevating block 60 moves upward and downward when the Y-axis-motor 58 is driven, and then the front end of the rotary grindstone 76 moves vertically. The above described structure is a so-called Scott-Russell's parallel-motion-mechanism. Namely, the relationship among the length P (the distance between the rotary shaft 74 of the rotary grindstone 76 and the elevating block 60), the length B (the distance between the elevating block 60 and the movable shaft 68), and the length G (the distance between the elevating block 60 and the shaft 62) will be:

$$G:B=B:P,$$

and the movable shaft 68 of the shaft 62 is set horizontally.

The movement for removing fins of the finishing machine will be explained.

To remove fins on a vertical face of a cast product M, the grindstone-base 52 is moved by driving the Z-axis-motor 84 and the rotary grindstone 76 is put into contact with the cast product M. Then the Y-axis-motor is driven to gradually move the elevating block 60 upward or downward.

While removing fins on the casted products M by the rotary grindstone 76, the diameter of the rotary grindstone 76 is gradually reduced due to abrasion. Therefore, fins on the casted product M cannot be perfectly removed with the prescribed movement of the rotary grindstone 76.

Then, correcting the amount of abrasion of the rotary grindstone 76 to the amount of travelling of the rotary grindstone 76 in the Z-direction causes proper removing. Therefore, it is suitable to measure the amount of abrasion of the rotary grindstone 76 at the start of the machine or once every prescribed number of operations.

The finishing machine of the present invention has a means for controlling, which includes a central processing unit (CPU), a ROM in which programs and data have been stored and a RAM in which N.C. control data of removing fins on cast products will be stored.

Figure 5:
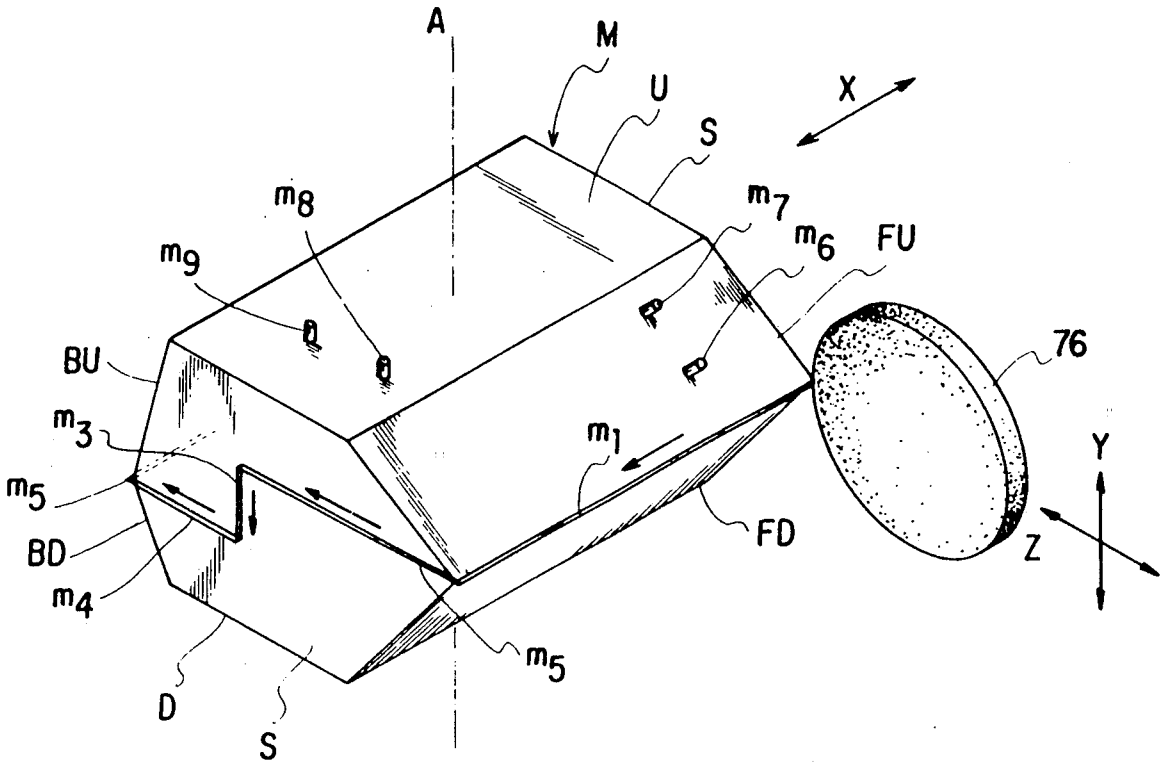
FIG. 5 shows a perspective view of a cast product.

Now, a case of the cast product shown in FIG. 5 will be explained. The cast product M has the upper face U, the bottom face D, the side faces S, the front face having the upper slope FU and the lower slope FD, and the rear face having the upper slope BU and the lower slope BD. There are formed a casting fin $m_1$ on the border area between the slopes FU and FD, crank-shaped casting fins $m_2$, $m_3$ and $m_4$ on the both side faces, and a casting fin $m_5$ on the border area between the slopes BU and BD. There also are unnecessary parts $m_6$, $m_7$, $m_8$ and $m_9$ corresponding to gas vent holes on the upper face U and the slope FD.

First, a teaching process is executed for removing fins on the sample product M with the rotary grindstone 76 so as to store control data in the RAM.

Next, the steps of the teaching will be explained.

The product M is clamped by the clamping device 20. The X-axis-motor 90 is driven to move the clamp-base 22 to the prescribed position so as to retract the whole machine in the casing. In this status, the height of the contact point of the rotary grindstone 76 is adjusted by driving the Y-axis-motor 58 and the rotary grindstone is put into contact with the fin $m_1$ by driving the Z-axis-motor 84, further the fin $m_1$ is removed while moving the product M by driving the X-axis-motor 90.

Next, the rotary grindstone 76 is moved backward by driving the Z-axis-motor 84 and the clamp-base 26 is rotated on the A-axis to face the side face S toward the grindstone-drive section 50. Then, the rotary grindstone 76 is put into contact with the fin $m_2$, simultaneously the product M is moved to remove the fin $m_2$. If the rotary grindstone 76 locates above the fin $m_3$, the movement of the product M in the Z-axis direction is stopped and the rotary grindstone 76 is descended by driving the Y-axis-motor 58. During this process, the rotary grindstone 76 removes the fin $m_3$ on the vertical face of the product M because of the Scott-Russell's mechanism. Holding the movement in the Y-axis direction, the cast product M is moved in the X-axis direction to remove the fin $m_4$. Then the rotary grindstone 76 is moved backward by driving the Z-axis-motor 84.

The product M is rotated on the A-axis by driving the A-axis-motor 28 to face the rear face of the product M toward the grindstone-drive section 50. The rotary grindstone 76 is put into contact with the end of the fin $m_5$ on the rear face by driving the Z-axis-motor 85 and the cast product M is moved in the X-axis direction by driving the X-axis-motor 90. Then fin $m_5$ is removed.

Successively, the fins $m_2$, $m_3$, $m_5$ on the other side face S are removed by the same manner for removing on the one side face S as described above.

Next, the front face of the product M is faced toward the grindstone-drive section 50. Locations of the fins $m_8$ and $m_9$, which are formed to line up in the Z-axis direction and which correspond to vent holes, in the Z-axis direction are coincided with the contact point of the rotary grindstone 76. Namely, the height of the contact point of the rotary grindstone 76 is coincided with the height of the upper face U of the product M by driving the Y-axis-motor 58. The fins $m_8$ and $m_9$ are removed by advancing the rotary grindstone 76 and then the rotary grindstone 76 is moved backward. Note that, the clamp head 32 for pressing the upper face of the product M has been moved upward before removing the fins $m_8$ and $m_9$ so as not to interrupt the removing work. If the product M is light, both side faces S and S should be clamped to keep its position; if the product is heavy, no clamping is required.

Next, the fins $m_6$ and $m_7$ corresponding to the vent holes on the slope FU of the front face will be removed. First, the fins $m_6$ and $m_7$, which are formed in the Z-axis direction, on the product M are moved in the X-axis direction to coincide their location in the Z-axis direction with the contact point of the rotary grindstone 76 by driving the X-axis-motor 90. The height of the contact point of the rotary grindstone 76 is coincided with the height of the upper face U of the product M by driving the Y-axis-motor 58. The rotary grindstone 76 is advanced to be close to the slope FU, and then the advancement (the movement in the Z-axis direction) of the rotary grindstone 76 is stopped. The rotary grindstone 76 is moved along the slope FU by adjusting the rotation of the Y-axis-motor 58 and the Z-axis-motor 84 so as to remove the fins $m_6$ and $m_7$.

Successively, the rotary grindstone 76 is moved back to the home position in the Y-axis and the Z-axis.

The cast product M is moved to the take-out position by driving the X-axis-motor 90 to be taken out.

The teaching is executed as described above, and control data are stored in the RAM. The RAM storing the data is backed up by batteries so as not to lost the data.

In the working mode, the fins $m_1$–$m_9$ on casted products are automatically removed by following the control program and the control data.

Figure 6:
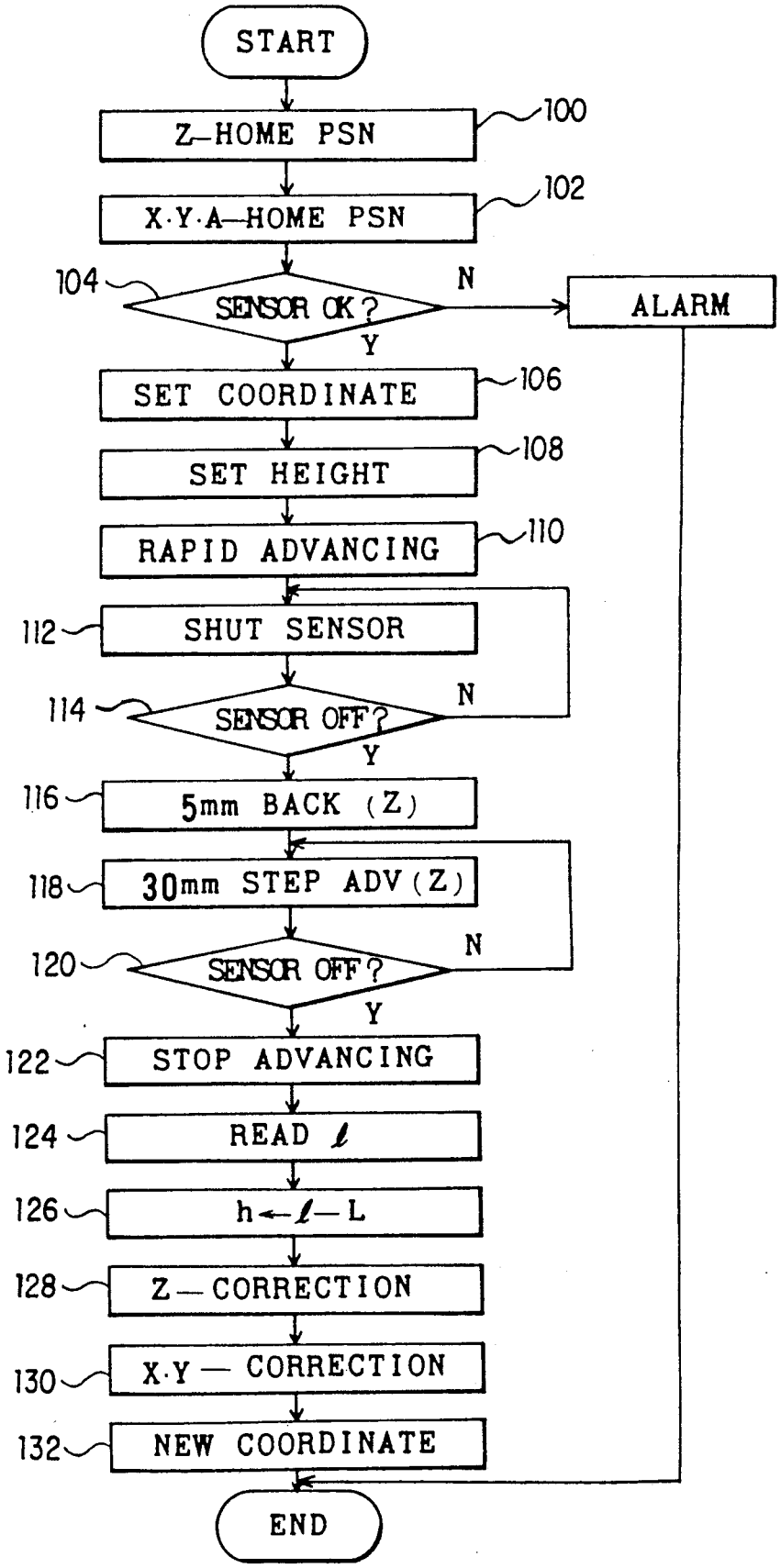
FIG. 6 shows a flow-chart for correcting the movement of the rotary grindstone.

As we described above, the rotary grindstone 76 wore with removing fins, so that the diameter of the rotary grindstone 76 will be reduced, then the function of detecting the amount of abrasion and correcting the movement of the rotary grindstone will be explained with reference to the flow-chart of FIG. 6.

Upon turning on the machine, the program is read by CPU to start. First, the Z-axis-motor 84 is driven to define the home position of the grindstone-base 52 in the Z-axis (step 100). Successively, home positions thereof in the X-axis, Y-axis and Z-axis are defined (step 102).

A sensor 92 having a light emitting section **92*a* and a light receiving section 92*b* (see FIGS. 2 and 4) confirms the position of the rotary grindstone 76 as a position detector (step 104). If it confirms to be allowable, step 106** is executed.

The coordinate system is defined based on the home position in the X-axis, Y-axis, Z-axis and A-axis directions (step 106).

Successively, the height of the axis (the center) of the rotary grindstone 76 is coincided with the height of the sensor 92 (step 108).

Advancing the rotary grindstone 76 to 10 mm short of the sensing position of the sensor 92 by driving the Z-axis-motor 84 (step 110).

Next, the grindstone-base 52 is advanced at slightly lower speed than the speed in step 110. With this advancing, the light is shut (step 114), then the grindstone-base 52 is moved 5 mm backward (step 116). Successively, the grindstone-base 52 is advanced at slower speed (step 118), and the rotary grindstone 76 shuts the light from the sensor 92 then the grindstone-base 52 is stopped (YES-branch of step 124). The distance in the Z-axis direction between the position at which the rotary grindstone has shut the light and the home position thereof is defined as l.

Figure 7:
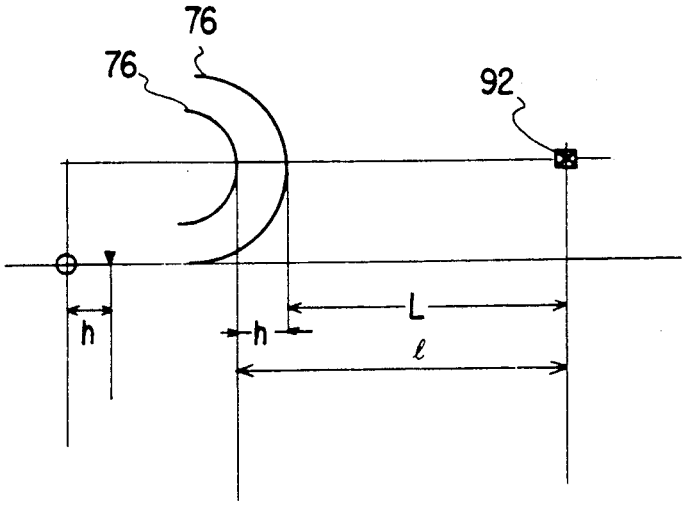
FIG. 7 shows an explanation view of the rotary grindstone and a sensor.

Note that, FIG. 7 shows the relationship between the rotary grindstone 76 and the sensor 92. During the teaching mode, the distance between the position of the grindstone-base 52 at which the rotary grindstone 76 shuts the light from the sensor 92 and the home position thereof is defined as L. In this case, the amount of abrasion h of the rotary grindstone 76 is:

$$h=l-L$$

Figure 8:
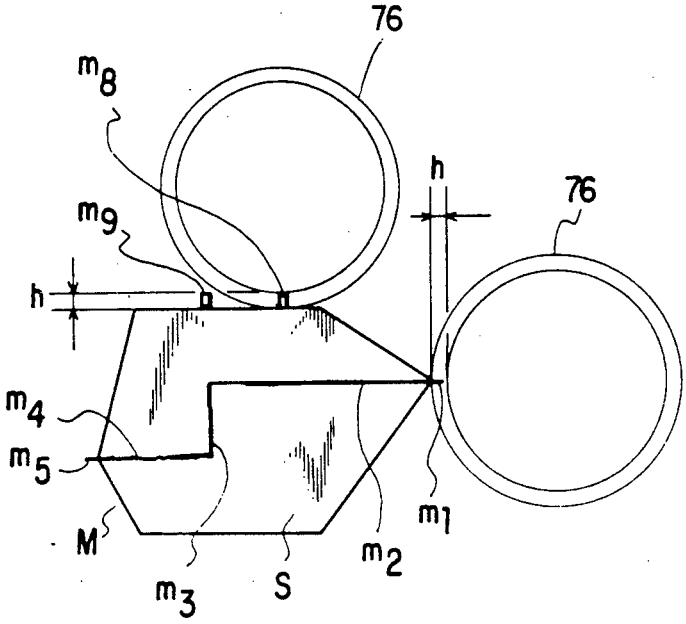
FIG. 8 shows a side view of the cast products.

The amount of abrasion h of the rotary grindstone 76 (sometimes described as correction value in the following description) is stored in the RAM (step 126), and the location of the home position in the Z-axis direction is corrected to add the correction value h thereto (step 128). Successively, further correction is also executed on the X-axis and the Y-axis directions (step 130). Then, the home position in each direction is corrected to define new coordinate system (step 132). Namely, the correction value h is added to the home position in the X-axis and Z-axis directions so as to remove fins on the vertical side faces and the horizontal upper face (see FIG. 8). To remove fins on the slopes, however, the correction value h should be divided into the Z-axis and Y-axis directions.

Fins on the cast product M are removed with reference to the control data in the RAM. Note that, preferably, the correction of the home position is executed at the start of the machine and once every prescribed number of removing works.

Figure 9:
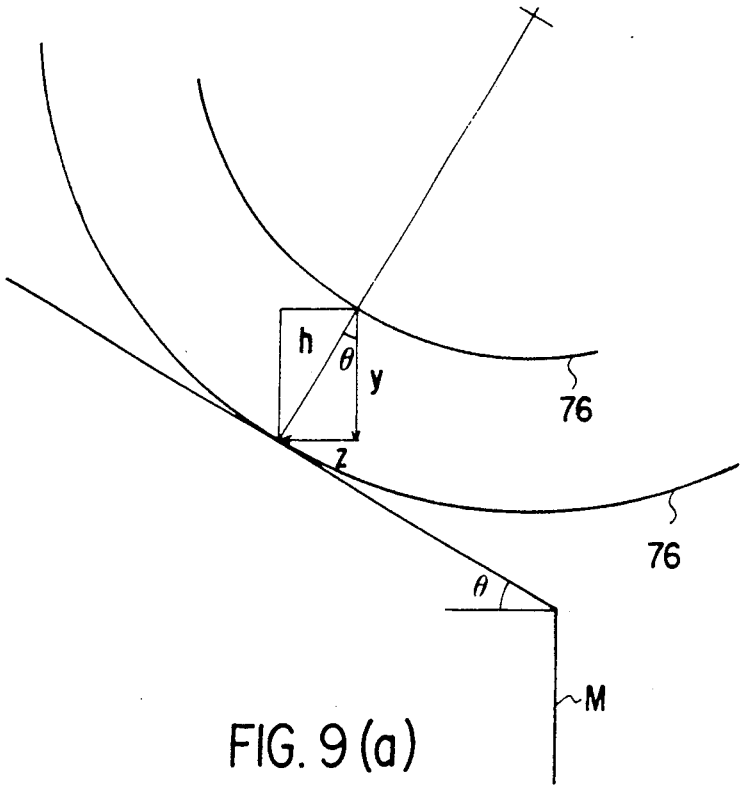
FIG. 9 shows an explanation view showing the correction for removing fins on a slope face.
Figure 9:
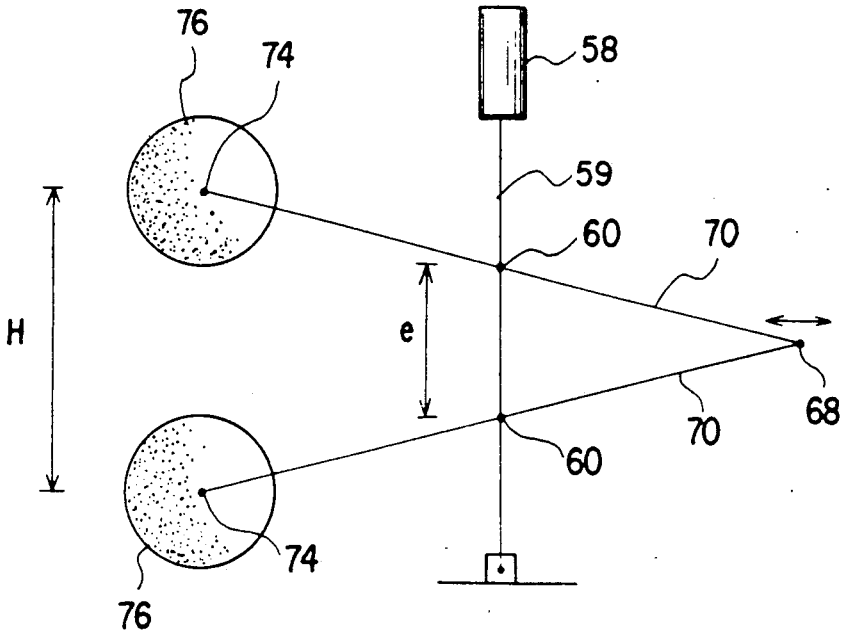

FIG. 9(*a*) explains how to correct the amount of abrasion h of the rotary grindstone 76 in the Z-axis and Y-axis directions to remove fins on the slopes.

The correction value z in the Z-direction of the amount of abrasion h of the rotary grindstone 76 is:

$$z=h\cdot\sin\theta$$

To correct the amount z, the grindstone-base 52 should be moved the length z.

While, the correction value y in the Y-direction thereof is:

$$y=h\cdot\cos\theta$$

In this case, the amount $y_1$ of travelling the elevating block 60, which travels on the ball bearing screw 59 driven by the Y-axis-motor 58 is:

$$y_1=h\cdot\cos\theta\cdot d$$

Now, the value d will be explained with reference to FIG. 9(*b*). If the amount of travelling the elevating block 60 on the ball bearing screw 59 driven by the Y-axis-motor 58 is defined as e; the amount of travelling of the rotary grindstone 76 is defined as H, the values have following relationship;

$$H:e=y:y_1,$$

and $$d=e/H.$$

Note that, the values H and e are proportioned each other.

In case of slopes, the values z and y are corrected in the Z-axis and Y-axis directions. Note that, the example of removing fins on slopes with adjusting the Y-axis-motor 58 and the Z-axis-motor 84 is described but fins on curved face can be removed by the same manner.

Figure 10:
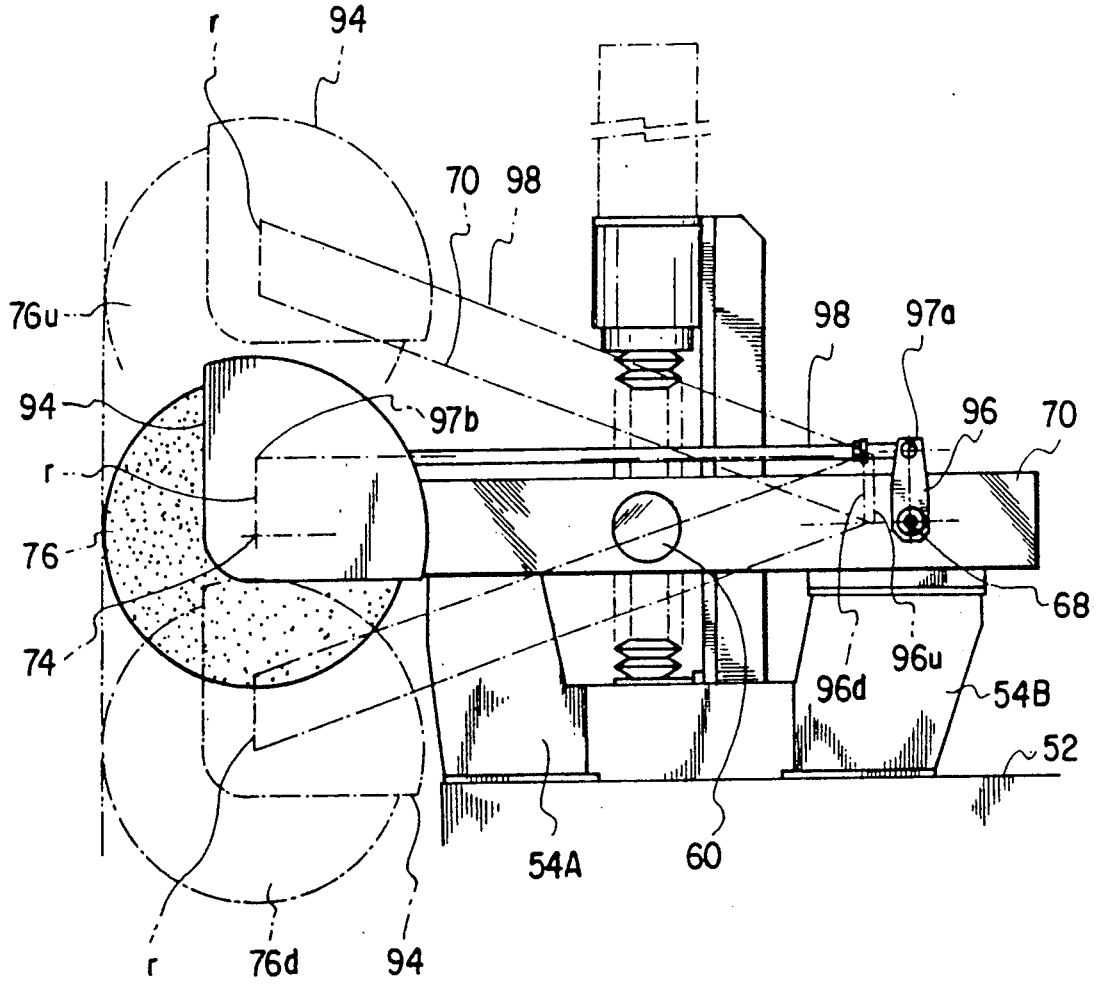
FIG. 10 shows a front view of the means for controlling the position of the grindstone cover.

Next, preferred means for controlling the position of a grindstone cover of the machine will be explained with reference to FIGS. 10–12.

There is provided a grindstone cover 94, which covers over the rotary grindstone 76 about angle range of 90°, at the front end of the first link 70. The grindstone cover 94 has side plates 94*a* and 94*a* facing each other and an arc-plate 94*b* connecting the side plates 94*a* and 94*a* and covering over circumferential faces thereof.

Figure 11:
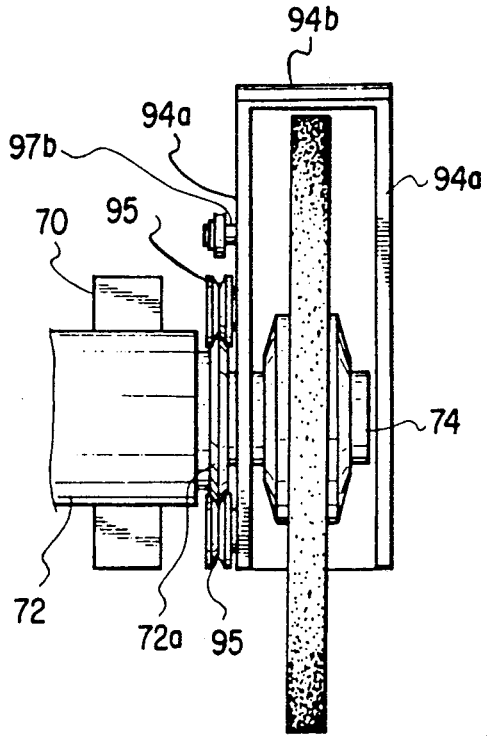
FIG. 11 shows a partial side view of the grindstone cover attached.
Figure 12:
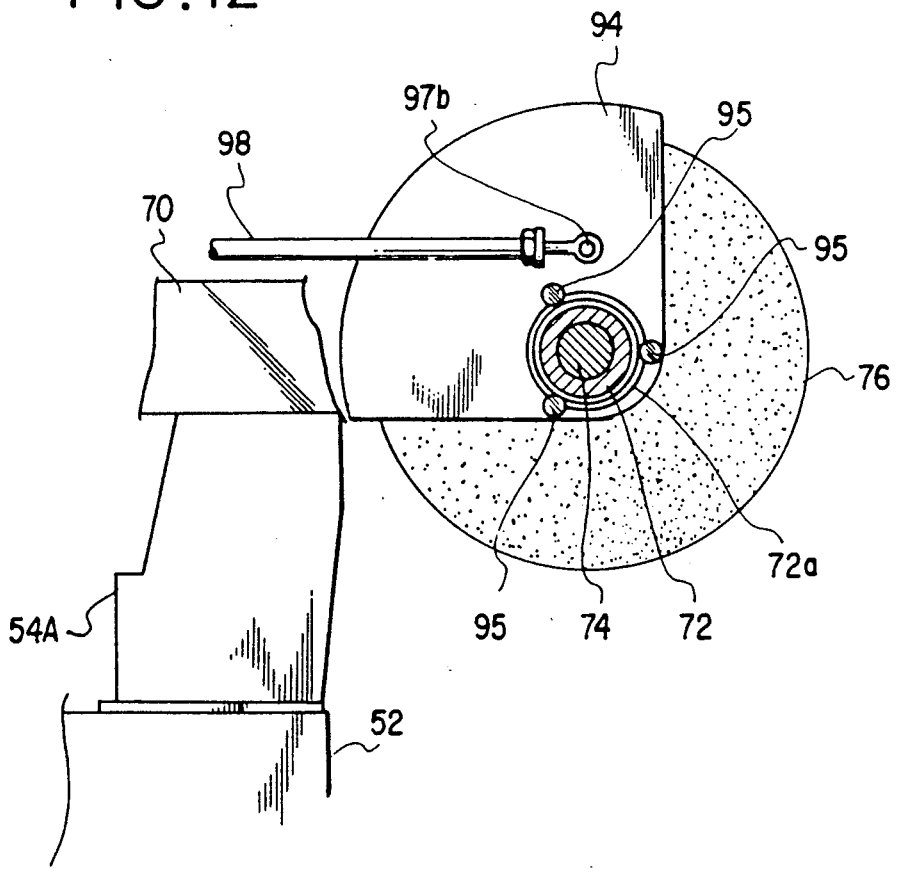
FIG. 12 shows a rear view of the grindstone cover attached.
Figure 13:
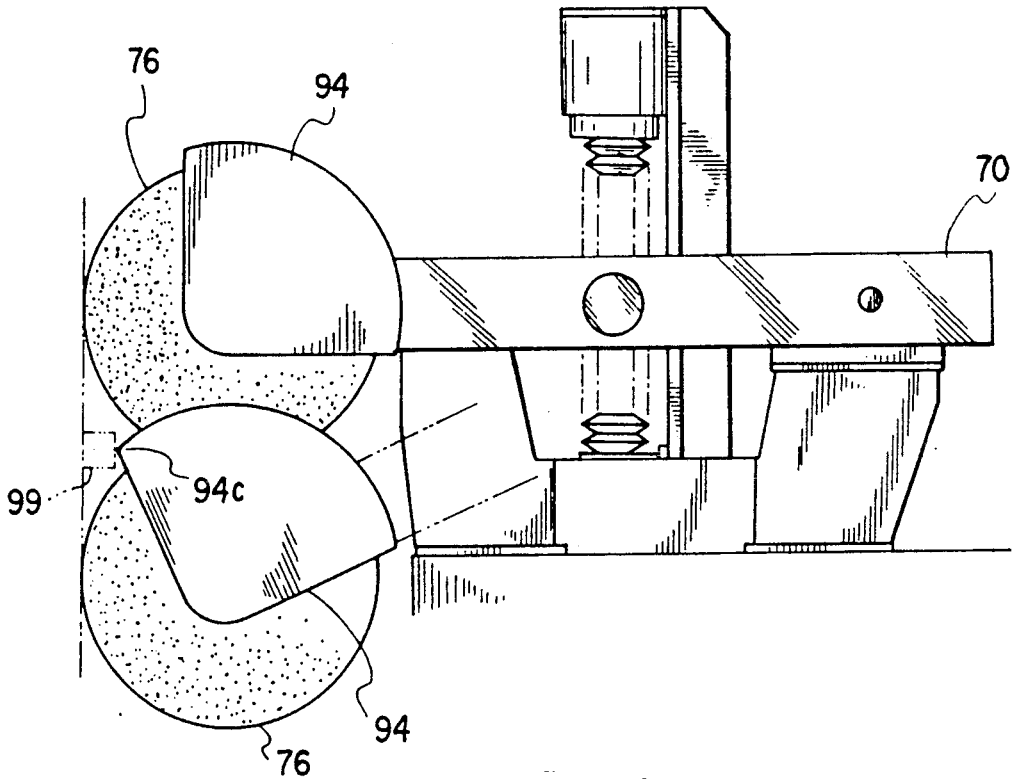
FIG. 13 shows an explanation view of the rotary grindstone descended.

There is projected a ring-like projected section 72*a* on the end face on the rotary grindstone side of the bearing 72, which is provided at the front end of the first link (see FIG. 11). There are three guide rollers 95 each of which has a groove, which can be fitted to the projected section 72*a*, on the side face of the grindstone cover 94. The guide rollers 95 are arranged to round the projected section 72*a* of the bearing 72 at regular interval (see FIG. 12). Therefore, the grindstone cover 94 can be rotated on the axis of the bearing 72.

A link plate 96 is vertically and coaxially fixed to the movable shaft 68, which is provided at the rear end of the first link 70. The upper end of the link plate 96 and the side plate 94*a* of the grindstone cover 94 are connected by a shaft 97*a* and 97*b* and a connecting rod 98. The connecting rod 98 is provided in parallel to the first link 70 (or the image line connecting the movable shaft 68 and the center of the rotary grindstone 76). A line r connecting the center of the rotary grindstone 76 and the shaft 97*b* is also vertical. The link plate 96, the connecting rod 98 and the first link 70 are composing a link system parallel to the first link 70 or the line r.

The uppermost position of the first link 70 is shown by one-dotted chain lines, and the rotary grindstone in this position is indicated by symbol 76*u*. In this status, the link plate 96 is advanced (advanced link plate is indicated by symbol 96*u*), then the liner vertically moved upward because of the link system, so that the position of the grindstone cover 94 can be kept vertically.

Similarly, the lowermost position of the first link 70 is also shown by one-dotted chain lines, and the rotary grindstone in this position is indicated by symbol 76*d*. In this status, the link plate 96 is advanced with the movement of the movable shaft 60 (advanced link plate is indicated by symbol 96*d*), and the position of the grindstone cover 94 can be kept vertically due to the link system.

Note that, as described above, if the grindstone cover 94 is not kept its position vertically, there is a disadvantage that the front end 94*c* of the grindstone cover 94 occasionally contacts a projected section 99 projected from the side face of the cast product as shown in FIG.

13 when the rotary grindstone 76 is descended. On this point, the machine of this embodiment has no disadvantage that the grindstone cover 94 contacts the cast product due to control of the position of the grindstone cover 94.

The means for controlling position of the grindstone cover 93, which exposes a third of the grindstone 76, will be explained with reference to FIG. 14.

The grindstone cover 93 can be coaxially rotated on to the rotary grindstone 76 because it has similar structure to above described grindstone cover 94.

The link plate 96 and the grindstone cover 93 are connected by the connecting rod 98, which connects them with similar structure to above described structure, and there is attached a cylinder unit 91 in the midway of the connecting rod 98. The exposed part of the rotary grindstone 76 can be changed by the operation of the cylinder unit 91.

Figure 14:
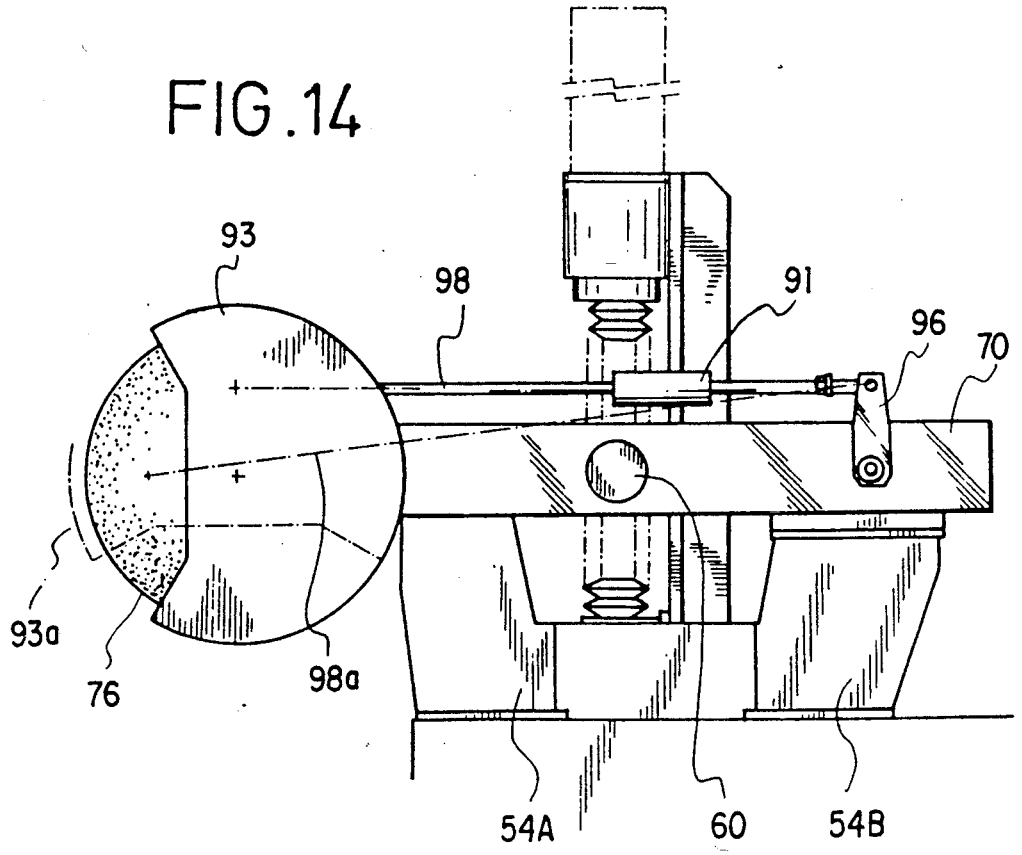
FIG. 14 shows a front view of the means for controlling the grindstone-drive section.

In FIG. 14, one-dotted chain lines show the position of the grindstone cover 93 which has been rotated 90° in clockwise direction (the grindstone cover is indicated as symbol 93*a*; the connecting rod is indicated as symbol 98*a*). In this case, the lower part of the rotary grindstone 76 is exposed, so fins on the upper face of the cast product can be removed. Similarly, it can be safer to remove fins because the exposed part of the grindstone 76 is directed to fins on the product.

In this means for controlling position of the grindstone cover 93, suitable control can be executed without interrupting fin-removing work by driving the link system and the cylinder unit 91. Note that, the cylinder unit 91 may be omitted.

Figure 19:
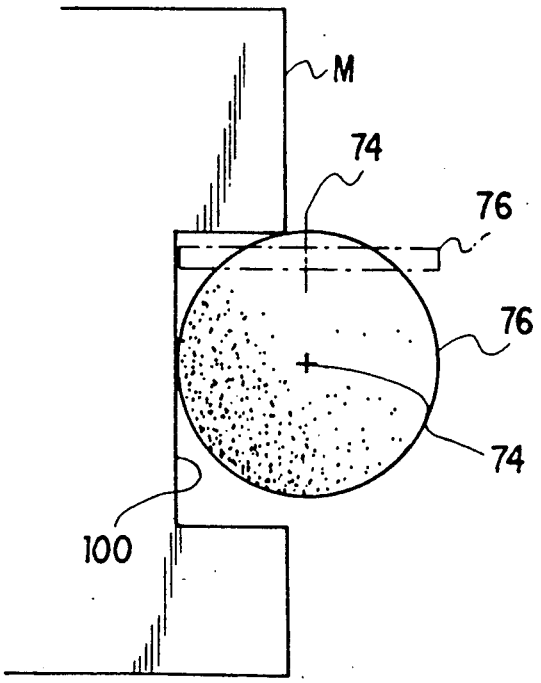
FIG. 19 shows an explanation view of the cast product and the rotary grindstone.
Figure 20:
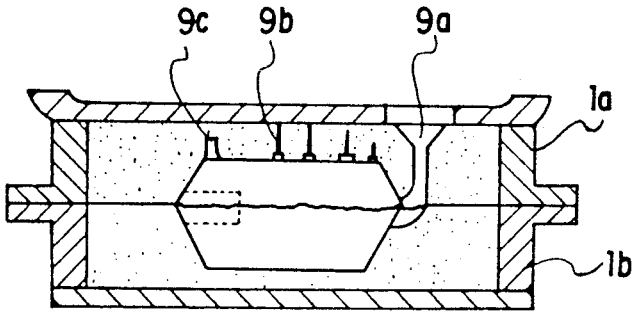
FIG. 20 shows a longitudinal sectional view of a mold.
Figure 21:
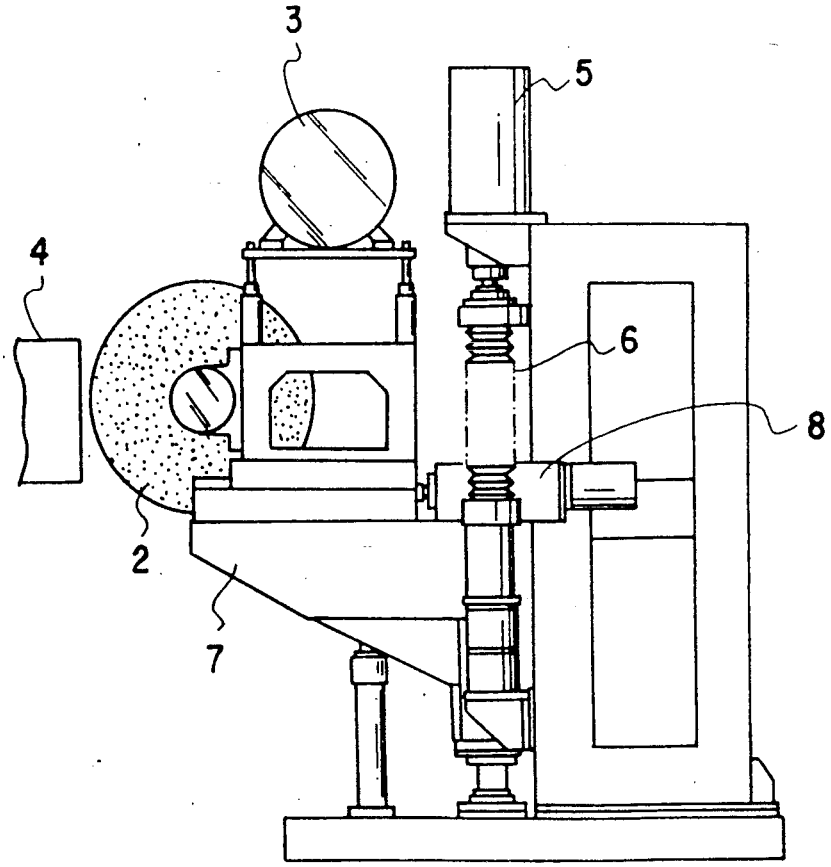
FIG. 21 shows a side view of a conventional finishing machine.

In the finishing machine of this embodiment, fins in the concave section 100 of the product M cannot be removed because the rotary grindstone 76 vertically moves close to the concave section 100 of the product M (see FIG. 19).

Then, the finishing machine 10 having a rotary mechanism 102 for changing the direction (shown as one-dotted chain lines in FIG. 19) of the rotary grindstone 76 will be explained.

Figure 15:
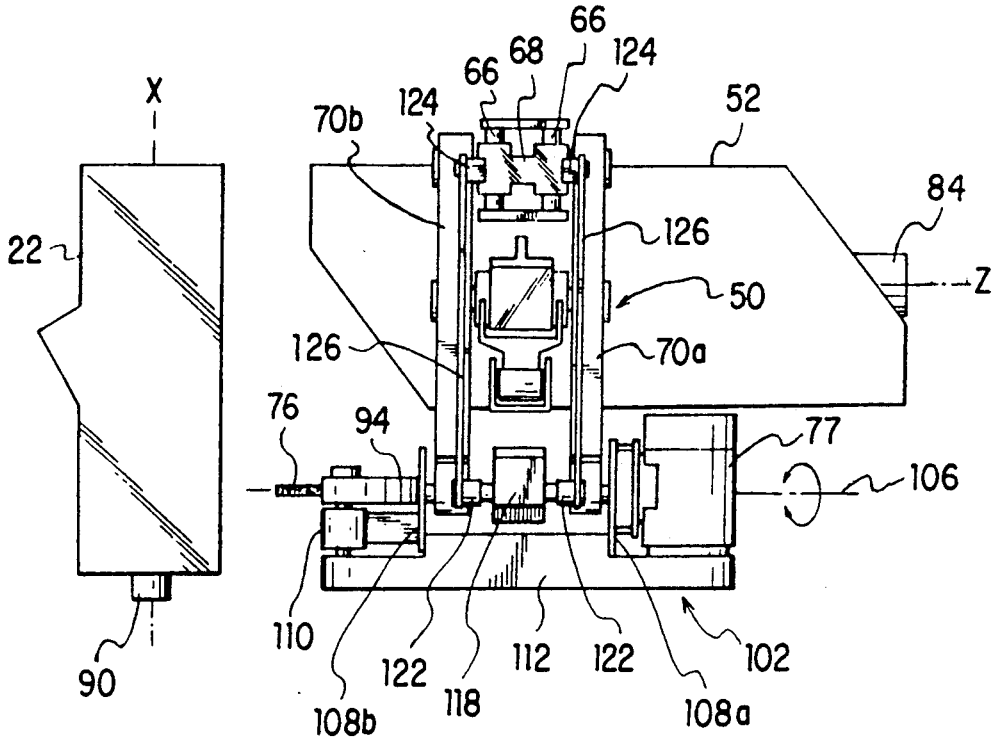
FIG. 15 shows a schematic plan view of the finishing machine having a rotary mechanism.
Figure 16:
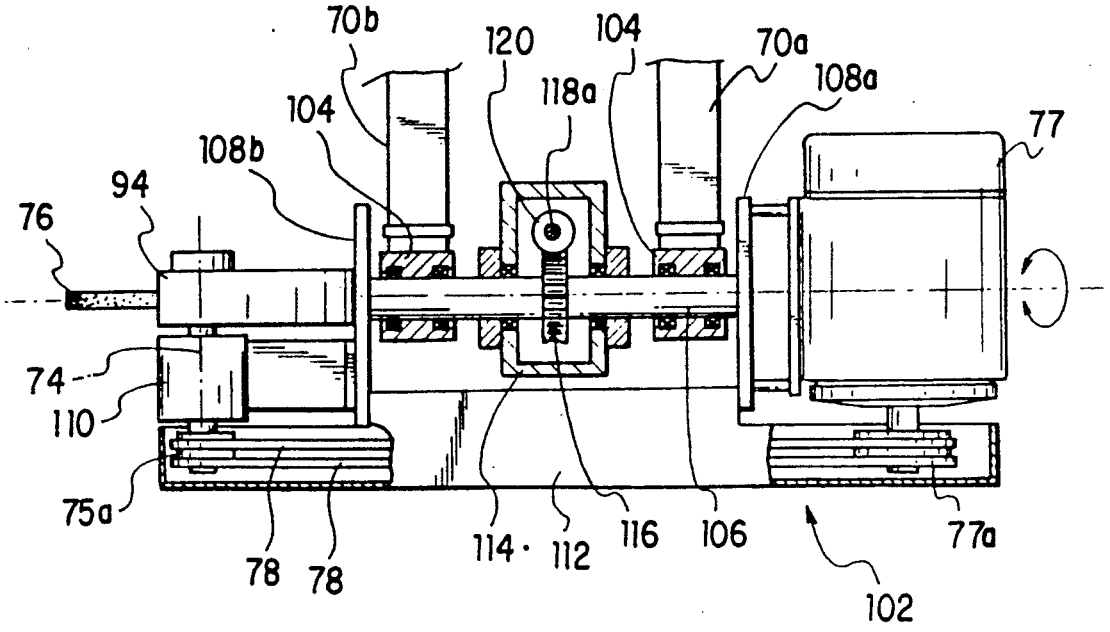
FIG. 16 shows a partial sectional plan view of the rotary mechanism.

In FIG. 15, the clamp-base 22 can be movable in the X-direction by the X-axis-motor 90 as same manner as the former embodiment. The grindstone-base 52 is movable in the horizontal Z-direction perpendicular to the X-direction. The grindstone-drive section 50 is mounted on the grindstone-base 52 parallel to the Z-direction as same manner as the former embodiment. The rotary mechanism 102 is provided at the front end of the first link 70.

The rotary mechanism will be described with reference to FIGS. 15–18.

There are respectively provided bearings 104 and 104 at the each front end of the side plates 70*a* and 70*b*. The rotary shaft 106 is rotatably supported by the bearings 104 and 104. There are respectively fixed plates 108*a* and 108*b* at each end of the rotary shaft 106. On the fixed plate 108*a*, the driving motor 77 is fixed; a bearing 104 rotatably supporting the rotary shaft 74 of the rotary grindstone 76 is fixed on the fixed plate 108*b*. The grindstone cover 94 covering over the rotary grindstone 76 is fixed to the fixed plate 108*b* coaxial to the rotary shaft 74. Belts 78 and 78 are engaged with the pulley 77*a* which is fixed at the front end of the drive shaft of the motor 77 and the pulley 75*a* which is fixed at the rotary shaft 74 of the rotary grindstone 76. Note that, the pulleys 77*a* and 75*a* and the belts 78 and 78 are covered with a belt-cover 112, which is fixed at the fixed plates 108*a* and 108*b* (see FIG. 16).

With this structure, the rotary grindstone 76, the motor 77, etc., which are fixed on the fixed plates 108*a* and 108*b*, can be rotated on the rotary shaft 106. There is provided a gear box 114 in the midway of the rotary shaft 106, and a gear 116 is fixed on the rotary shaft 106 in the gear box 114. A motor 118 is fixed on the upper face of the gear box 114, and a worm gear 120, which engages with the gear 116 on the rotary shaft 106, is fixed on a shaft 118*a*, which is transmitted rotary force from the motor 118 (see FIG. 16). Supporting arms 122 and 122 are upwardly extended in parallel to the rotary shaft 106 from the both side faces of the gear box 114 (see FIG. 18). While supporting members 124 and 124 stand on the movable shaft 68, which is provided at the rear end of the first link 70. The supporting members 124 and 124 and the supporting arms 122 and 122 are respectively and pivotably attached to connecting plates 126 and 126.

Figure 17:
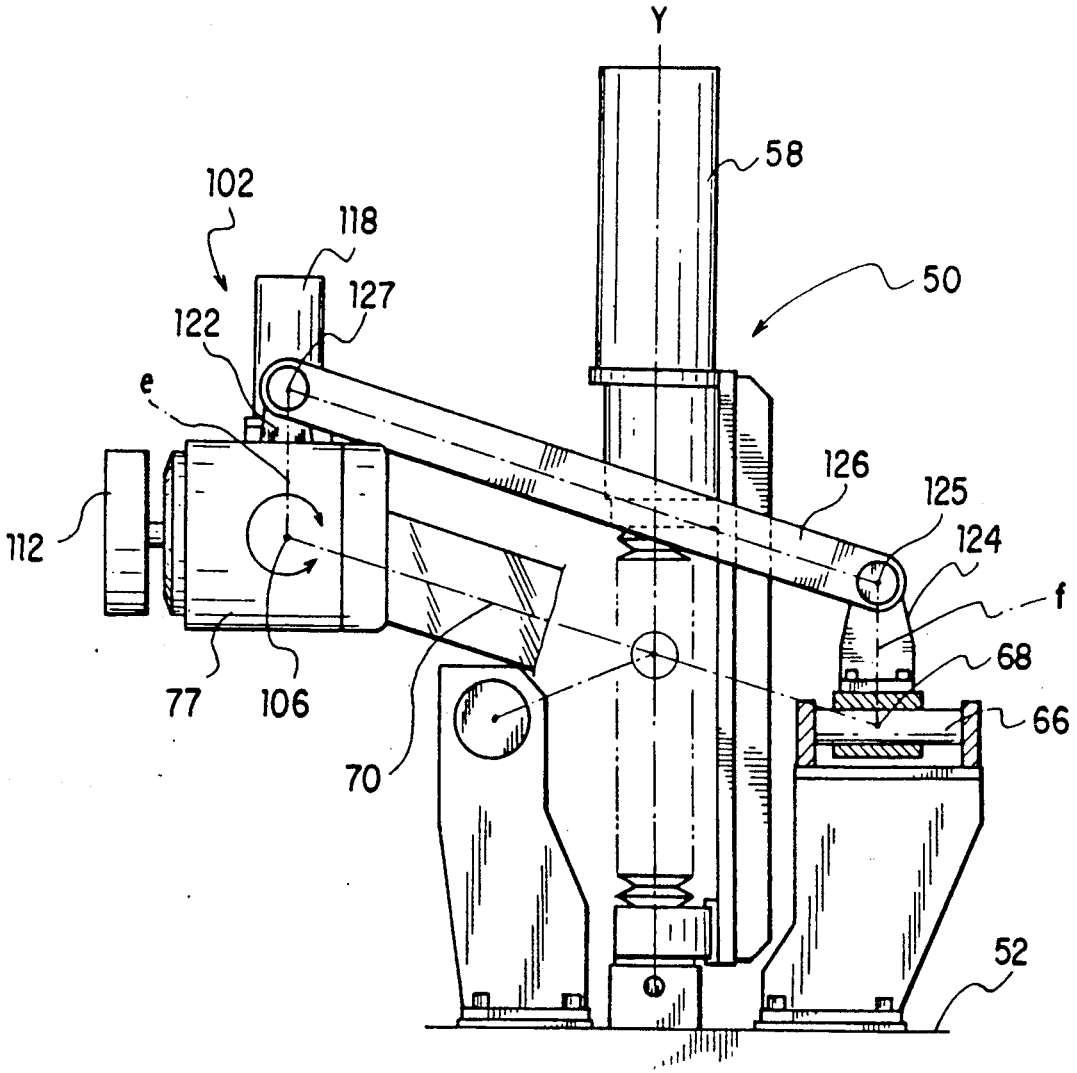
FIG. 17 shows a schematic front view of the grindstone-drive section.
Figure 18:
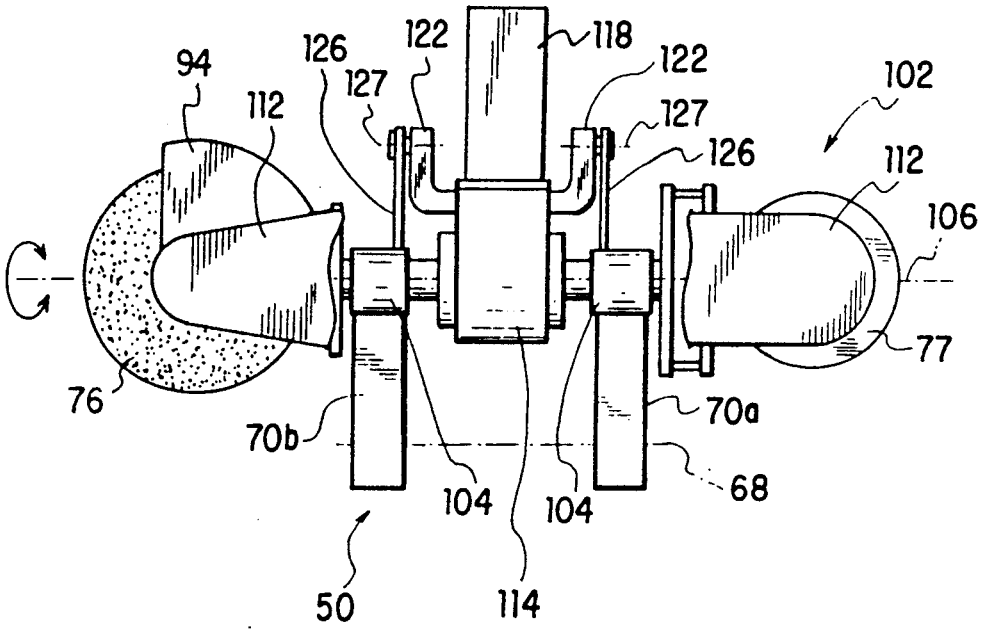
FIG. 18 shows a schematic side view of the grindstone-drive section in the direction from the rotary mechanism.

As shown in FIG. 17, a shaft 127 to which the supporting arm 122 and the connecting plate 126 are pivotably attached and the rotary shaft 106 are vertically kept their relationship and a vertical link is defined as e. A link f, which connects a shaft to which the supporting member 124 and the connecting plate 126 are pivotably attached and the movable shaft 68, is also kept vertically.

With this structure, a parallel link system is formed by the connecting plate 126, the first link 70, the links e and f. Therefore, the gear box 114 is always kept its position vertical because the links e and f always kept their position vertical when the front end of the first link 70 is moved up and down.

When the motor 118 is driven, the rotary shaft 106 is rotated by the mechanism including the worm gear 120 on the shaft 118*a* and the gear 116 engaging with the worm gear 120, and the rotary grindstone 76 can be rotated on the rotary shaft 106. The rotary grindstone 76 can be changed its position from the horizontal position to veriety of inclined positions are shown by one-dotted chain lines in FIG. 19.

In this embodiment, there is provided the rotary mechanism 102 at the front end of the first link 70, so that fins in the concave section 100 of the cast product M can be removed.

Preferred embodiments of the present invention have been described as above but the present invention is not limited to the above embodiments. Many modifications can be allowed without deviating the spirit of the invention.

We claim:

1. In a finishing machine for cast products comprising a rotary grindstone for removing unnecessary parts on a work while moving relatively close to said work, wherein the improvement comprises:

a clamp-base movable in the horizontal X-direction;

a clamping device for clamping said work, said clamping device being provided on said clamp-base and being rotatable on an A-axis that is perpendicular to the X-direction;

a grindstone-base movable in the horizontal Z-direction perpendicular to the X-direction so as to be movable toward and away from said clamp-base;

a support-shaft having a first end pivotably attached to said grindstone-base, said support-shaft being swingable in a vertical plane perpendicular to the X-direction;

an elevating block movable on said support-shaft;

a link having a first end movable on said support-shaft by the movement of said elevating block, said first end of said link being pivotably attached to said elevating block and a second end opposite said first end pivotably attached to said grindstone-base said link having a length G;

a swing arm pivotably attached to said elevating block at a portion of said swing arm intermediate its ends so as to be swingable in a vertical plane perpendicular to the X-direction, means for mounting a first end of said swing arm to be movable along a guide section on the grindstone-base in the Z-direction, said rotary grindstone being rotatable on a rotary shaft extending in the X-direction and being movable in the Y-direction by the movement of said elevating block, said rotary grindstone being mounted at the end of said swing arm opposite said one end thereof, the distance P between the rotary shaft and elevating block, the distance B between the elevating block and said first end thereof, being related by the relationship G:B=B:P;

means for controlling drive units of said clamp-base, said clamping device, said grindstone-base and said elevating block so as to remove said unnecessary parts produced on the upper face and/or the circumferential faces of said work;

means for detecting the amount of abrasion of said rotary grindstone; and means for correcting the amount of travelling said grindstone-base and/or said elevating block corresponding to the amount of abrasion of said rotary grindstone.

2. In a finishing machine for cast products comprising a rotary grindstone for removing unnecessary parts on a work while moving relatively close to said work, wherein the improvement comprises:

a clamp-base movable in the horizontal X-direction;

a clamping device for clamping said work, said clamping device being provided on said clamp-base and being rotatable on an A-axis that is perpendicular to the X-direction;

a grindstone-base movable in the horizontal Z-direction perpendicular to the X-direction so as to be movable toward and away from said clamp-base;

a support-shaft having a first end pivotably attached to said grindstone-base, said support-shaft being swingable in a vertical plane perpendicular to the X-direction;

an elevating block movable on said support-shaft;

a link having a first end movable on said support-shaft by the movement of said elevating block, said first end of said link being pivotably attached to said elevating block and a second end opposite said first end pivotably attached to said grindstone-base said link having a length G;

a swing arm pivotably attached to said elevating block at a portion of said swing arm intermediate its ends so as to be swingable in a vertical plane perpendicular to the X-direction, means for mounting a first end of said swing arm to be movable along a guide section on the grindstone-base in the X-direction, said rotary grindstone being rotatable on a rotary shaft extending in the X-direction and being movable in the Y-direction by the movement of said elevating block, said rotary grindstone being mounted at the end of said swing arm opposite said one end thereof, the distance P between the rotary shaft and elevating block, the distance B between the elevating block and said first end thereof, being related by the relationship G:B=B:P;

means for controlling drive units of said clamp-base, said clamping device, said grindstone-base and said elevating block so as to remove said unnecessary parts produced on the upper face and/or the circumferential faces of said work;

means for detecting the amount of abrasion of said rotary grindstone; and means for correcting the amount of travelling said grindstone-base and/or said elevating block corresponding to the amount of abrasion of said rotary grindstone.

3. A finishing machine for cast products according to claim 1, wherein:

said means for correcting comprises means for adding the amount of abrasion of said rotary grindstone to the amount of travelling of said rotary grindstone in the Z-direction when unnecessary parts on the face parallel to the A-axis are removed;

said means for correcting comprises means for adding the amount of abrasion to the amount of travelling of said rotary grindstone in the Y-direction when unnecessary parts on the upper face parallel to said clamp-base are removed; and said means for correcting comprises means for dividing the amount of abrasion to add to each of the amount of travelling of said rotary grindstone in the Z-direction and Y-direction when fins, etc. on slope and curved faces are removed.

4. A finishing machine for cast products according to claim 2, wherein:

said means for correcting comprises means for adding the amount of abrasion of said rotary grindstone to the amount of travelling of said rotary grindstone to the amount of travelling of said rotary grindstone in the Z-direction when unnecessary parts on the face parallel to the A-axis are removed;

said means for correcting comprises means for adding the amount of abrasion to the amount of travelling of said rotary grindstone in the Y-direction when unnecessary parts on the upper face parallel to said clamp-base are removed; and said means for correcting comprises means for dividing the amount of abrasion to add to each of the amount of travelling of said rotary grindstone in the Z-direction and Y-direction when fins, etc. on slope and curved faces are removed.

5. A finishing machine for cast products according to claim 1, further comprising a grindstone cover covering said rotary grindstone, whereby a first part of said grindstone is exposed therefrom, said grindstone cover being coaxial to said rotary grindstone and being rotatable can be rotated; and means for controlling the position of said grindstone cover to face the exposed part of said rotary grindstone to a face on which unnecessary parts are produced.

6. A finishing machine for cast products according to claim 2, wherein a bearing for supporting said rotary grindstone and a motor for driving said rotary grindstone are respectively fixed at opposite ends of a rotary shaft which is rotatable on an axis in the Z-direction and which is rotatably supported by bearings fixed at the front end of said swing arm.

* * * * *